US007172359B2

(12) United States Patent
Möck

(10) Patent No.: US 7,172,359 B2
(45) Date of Patent: Feb. 6, 2007

(54) MARKING IMPLEMENT

(76) Inventor: Gerhard Möck, Waldstrasse 4B, Kirchehrenbach (DE) D-91356

( * ) Notice: Subject to any disclaimer, the term of this patent is extended or adjusted under 35 U.S.C. 154(b) by 358 days.

(21) Appl. No.: 10/896,412

(22) Filed: Jul. 21, 2004

(65) Prior Publication Data

US 2006/0018700 A1 Jan. 26, 2006

(51) Int. Cl.
*B43K 5/00* (2006.01)

(52) U.S. Cl. ..... 401/202; 401/213; 401/243; 401/244

(58) Field of Classification Search ..... 401/131, 401/196, 198, 202, 213, 243–247, 262, 269
See application file for complete search history.

(56) References Cited

U.S. PATENT DOCUMENTS 5,066,156 A * 11/1991 Petrillo et al. ..... 401/202
5,716,152 A * 2/1998 Kudo ..... 401/202

FOREIGN PATENT DOCUMENTS

DE 100 49 488 A1 4/2002
EP 0 752 932 B1 1/1997

* cited by examiner

*Primary Examiner*—Tuan Nguyen
(74) *Attorney, Agent, or Firm*—Laurence A. Greenberg; Werner H. Stemer; Ralph E. Locher

(57) ABSTRACT

A marking implement for marking activities such as marking of a drill hole or indicating a cutting/sawing edge, and includes a marking pen having a pen housing and an application reservoir held in a axially fixed manner therein and a protective cap with an elongate interior for partially accommodating the marking pen. The marking pen has a gripping region and, adjoining it, a thinner neck region, on which a nib is formed at the free end. The cap has an interior section for partially accommodating the gripping region and a narrower interior section for accommodating the neck region. Furthermore, a fastening clip is disposed on the outer surface of the cap. The clip is integrally formed on the protective cap with a fixed end in a region adjacent to the opening and, from there, tapers substantially to the end of the cap that faces away from the opening.

31 Claims, 4 Drawing Sheets

FIG. 1A
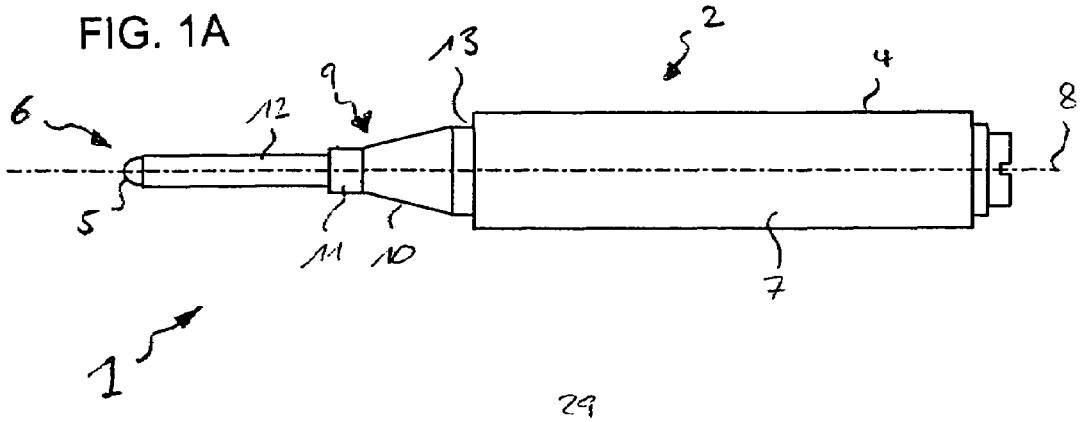
FIG. 1B
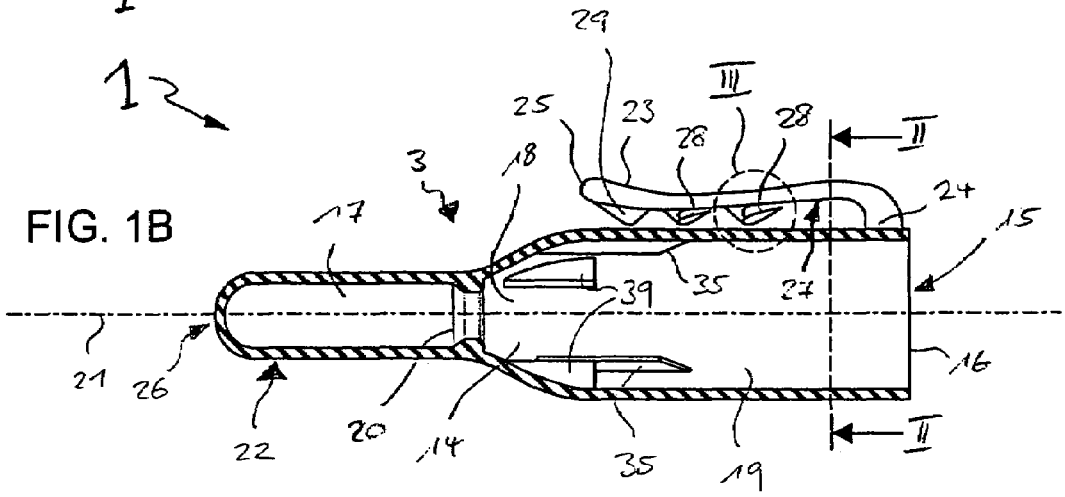
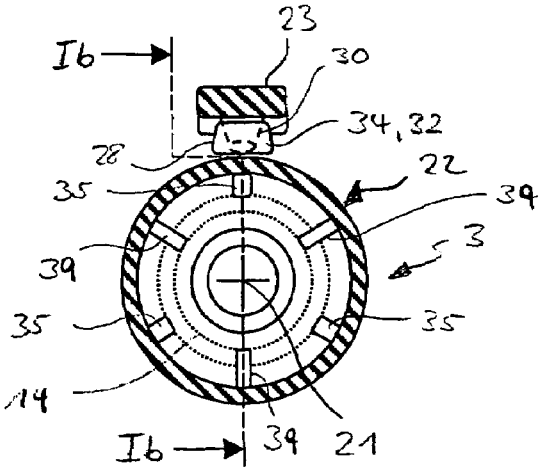
FIG. 2
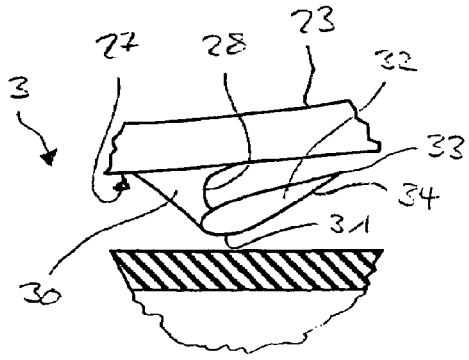
FIG. 3

MARKING IMPLEMENT

BACKGROUND OF THE INVENTION

Field of the Invention

The invention is concerned with a marking implement, in particular, for drawing, marking, or labeling drill holes, cutting edges, layout lines, or the like.

In particular, in the course of a manual activity it is customary to mark a drill hole, a cutting or sawing edge, or a desired layout line in advance on part of a structure to be created, a wall, a ceiling, or the like. A ruler, a template, or the like is usually placed onto the object to be marked as an indication for the marking that is to be provided. Use is frequently also directly made of a further part that is to be attached to or disposed on the object to be marked as a template for the first part. For example, it is customary, to provide a drill hole serving to screw together two parts, to place a first part, which is provided with a pre-manufactured hole, onto a second part, into which a hole is to be drilled, in the desired fastening position and to mark the drill hole, which is to be provided, in advance on the second part through the hole in the first part.

A writing instrument, in particular a pencil, ball-point pen, or fiber-tipped pen, is used generally for such marking work. However, the provision of markings by a conventional writing instrument is frequently associated with handling difficulties. Firstly, the points that are to be marked are accessible frequently only with difficulty using a conventional writing instrument. This applies, in particular, if a marking is to be provided at the bottom of a slim and deep hole or a line is to be drawn behind a wide spacing edge. A conventional writing instrument is frequently too wide for such marking work. Secondly, a sufficiently thin writing instrument is also often not very well suited to such marking activity due to lacking robustness, and, in particular, is subject to rapid wear and a high risk of damage.

A fiber-tipped pen having a pen housing and an application reservoir, which protrudes out of the pen housing and is fixed in an axially movable manner, is disclosed, for example, in German Published, Non-Prosecuted Patent Application DE 100 49 488 A1. In the case of the known pen, the application reservoir is surrounded by a small protective tube that can be pushed back axially with respect to the application reservoir in the direction of the housing with a defined force being exerted to automatically readjust the small protective tube as the application reservoir is being used up in a manner corresponding to the particular period of use. A fiber-tipped pen is always used together with a corresponding protective cap that protects the nib of the pen against drying out.

Furthermore, European Patent 0 752 932 B1 discloses a writing or drawing implement having a writing instrument and a removable cap. In this case, the cap is provided with a fastening clamp, which is fixed on the open side of the cap and is orientated with its free end in the direction of the closed end of the cap.

SUMMARY OF THE INVENTION

It is accordingly an object of the invention to provide a marking implement that overcomes the hereinafore-mentioned disadvantages of the heretofore-known devices of this general type and that is particularly suitable for a marking activity of the type mentioned above.

With the foregoing and other objects in view, there is provided, in accordance with the invention, a marking implement, including a marking pen having a pen housing having a relatively wide gripping region and a relatively thin neck region adjoining the gripping region, the neck region having a free end side and a nib on the free end side, and an application reservoir axially fixedly held in the pen housing, a protective cap defining an elongate interior opening out at a cap opening for at least partially accommodating the marking pen therein, the cap having an outer surface and an end facing away from the cap opening, the interior of the cap having, a relatively wide interior section for at least partially accommodating the gripping region of the marking pen and a relatively narrow interior section for accommodating the neck region of the marking pen, and a fastening clip being disposed on the outer surface of the cap, being integrally formed on the cap, having a fixed end connected to the cap in a region adjacent the cap opening, a free end closer to the end of the cap facing away from the opening than the fixed end, and tapering from the fixed end towards the free end.

The marking implement includes a marking pen, in particular, a fiber-tipped pen, and a protective cap for the marking pen. The marking pen includes a pen housing and an application reservoir held in an axially fixed manner in it, and is divided into a wide gripping region and an axially adjoining, thin neck region. In such a case, a nib at which the application reservoir protrudes out of the pen housing is formed on the free end of the neck region. The protective cap has an elongate interior that opens out in an opening and is provided for partially accommodating the marking pen. The interior is matched to the shape of the marking pen. The interior includes, in particular, a narrow interior section for accommodating the neck region, and a wide interior section for partially accommodating the gripping region of the marking pen. A fastening clip is, furthermore, disposed on the outer surface of the protective cap. This fastening clip is integrally formed on the protective cap in a region adjacent to the opening and, from there, tapers substantially to the end of the protective cap that faces away from the opening.

The above-described marking implement considerably simplifies marking and drawing work. As a result of its comparatively wide gripping region, the marking pen is, thus, stable and ergonomic, in particular, it can readily be grasped. On the other hand, the thin neck region of the marking pen makes it possible to provide a marking even at a point to which access is difficult, through a comparatively deep and narrow hole, or behind a wide spacing edge.

The marking pen is not only effectively protected against drying out by matching the protective cap to the shape of the marking pen and, in particular, when the marking pen is inserted, by it accommodating not only the neck region thereof, but also part of the gripping region. On the contrary, the protective cap, thereby, also effectively protects the thin and, therefore, comparatively sensitive neck region of the marking pen against damage.

In accordance with another feature of the invention, a particular simplification of the handling is obtained by providing the fastening clip according to the invention. This, namely, permits the protective cap to be fastened in the manner of a quiver with the opening upward to a pocket of the work clothes or the like, and therefore, in particular, to the body. Such a configuration enables the marking pen to be pulled in a simple manner, in particular, one-handed, out of the protective cap and to be inserted back after use into the protective cap (which is still fastened to the work clothes or the like). The effect achieved thereby is that the marking pen can be grasped at any time, but, on the other hand, for the period when it is not in use is well protected at all times against damage, drying out, etc. The possibility of fastening the marking implement on the body and the simple, one-handed usability are of particular importance during a marking activity, particularly because, here, as a rule, one hand is required for placing on and holding a ruler, a template, or a part used as a template, and there is not generally a secure possibility of depositing the marking pen within reach.

In accordance with a further feature of the invention, to prevent the protective cap from becoming detached inadvertently from the pocket or the like to which it is fastened, when the marking pen is pulled out, at least one blocking element is formed on the inner surface of the fastening clip, the blocking element "clawing" against the material, the pocket or the like, in the manner of a barb and, therefore, counteracting an inadvertent pulling out of the protective cap. The or each blocking element is, preferably, in turn configured in the form of a resilient clip that is integrally formed on one side of the fastening clip. In such a form, the blocking element includes a retaining limb, with which it is integrally formed on the inner surface of the fastening clip, and a free limb that is angled away from this retaining limb. In such a case, the retaining limb protrudes from the inner surface of the fastening clip obliquely in the direction of the fixed end of the fastening clip while the free limb, in turn, is orientated obliquely in the direction of the inner surface of the fastening clip.

In accordance with an added feature of the invention, to hold the or each blocking element in a stable manner on the fastening clip, on one hand, and in order to ensure good spring elasticity of the blocking element, on the other hand, the retaining limb is expediently configured such that it tapers from the inner surface of the fastening clip in the direction of the free limb. The formation of the free limb of the or each blocking element as a supporting plate enables, on one hand, a good retaining action of the or each blocking element to be achieved, but, on the other hand, effectively prevents the work clothes or the like, to which the protective cap is fastened, from being damaged, in particular, torn, by the blocking element.

In accordance with an additional feature of the invention, the retaining limb tapers outwardly from the inner surface of the fastening clip in a direction of the free limb.

In accordance with yet another feature of the invention, there is provided a sealing bead on the inner surface of the protective cap. By the bead, the marking pen, in the state in which it is inserted into the protective cap, is effectively protected against drying out. This protective effect is assisted, in particular, by configuring the sealing bead to surround the marking pen in its neck region in a sealing manner. The configuration namely keeps the interior volume of the protective cap surrounding the nib of the marking pen particularly small, as a result of which, the evaporation of the solvent of the pen ink is minimized.

In accordance with yet a further feature of the invention, there is preferably provided a step-like shoulder between the gripping region and the neck region of the marking pen, which serves, in interaction with a stop provided in the interior of the protective cap, to limit the introducing distance of the marking pen into the protective cap in a well-defined insertion position.

In accordance with yet an added feature of the invention, the outside diameter of the gripping region of the marking pen, on one hand, and the inside diameter of the wide interior section of the protective cap, on the other hand, are, preferably, matched to each other such that, when the marking pen is inserted into the protective cap, an annular gap is formed between the latter and the protective cap. Such a configuration effectively avoids the protective casing becoming soiled by particles of dust or the like adhering to the marking pen or the marking pen even becoming jammed in the protective casing. For such a purpose, the radial thickness of the annular gap is at least 0.2 mm. The radial thickness of the annular gap, preferably, lies in a range between 0.3 mm and 0.5 mm, in particular, at approximately 0.35 mm. In such a case, the marking pen is, preferably, held coaxially with the protective cap by a centering projection or a plurality of interacting centering projections that, when the marking pen is inserted, bears/bear against the outer circumference of the gripping region. The centering projection or the centering projections is/are, preferably, dimensioned such that it/they acts/act radially on the inserted marking pen in the gripping region and, therefore, retain it captively in the protective cap.

In accordance with yet an additional feature of the invention, the application reservoir is fluidically connected to the nib.

In accordance with again another feature of the invention, the application reservoir of the marking pen is surrounded in the region of the nib by a small protective tube that can be displaced back axially with respect to the application reservoir in the direction of the pen housing with a defined force being exerted. The small protective tube stabilizes the application reservoir in a particularly effective manner so that even rough surfaces that greatly stress the application reservoir in the region of the nib can be written on without the application reservoir being damaged, in particular, "frayed", in the region of the nib. The ability of the small protective tube to be displaced back has the effect, on the other hand, that, as the application reservoir continues to be used up, the small protective tube is successively and automatically readjusted so that a writing performance that always remains the same is provided regardless of the degree to which the application reservoir is used up. The defined push-back force for the small protective tube is set, in particular, by the inside diameter of the small protective tube being matched, taking into consideration a frictional fit tolerance, to the diameter of the application reservoir. In such a case, the frictional fit tolerance determines the defined push-back force.

To limit the push-back distance of the small protective tube with respect to the application reservoir and thereby, in particular, to specify a defined minimum length of the marking pen, in accordance with again a further feature of the invention, a stop, which is fixed on the housing, is provided for the small protective tube. This stop is, expediently, formed on the pen housing or on a part connected fixedly thereto. The application reservoir is, preferably, additionally stabilized in the region of the nib by a guide section, which is formed in the region of the nib in the pen housing, in particular, a guide hole, for the small protective tube.

In accordance with again an added feature of the invention, the application reservoir includes two axially adjoining reservoir sections of different diameter. In such a case, a first, in particular, thinner, reservoir section is disposed in the region of the nib and is surrounded by a small protective tube that has an inside diameter matched, taking a frictional fit tolerance into consideration, to the diameter of this first reservoir section. A second reservoir section is disposed on the housing with respect to the first reservoir section. In this variant, the second reservoir section expediently forms a stop limiting the push-back distance of the small protective tube.

The effect firstly achieved by providing that end of the small protective tube that is on the housing with an overhang is that the small protective tube is supported, in an entirely pulled-back position, flat against a housing stop or, if appropriate, against the wide reservoir section acting as a stop. As a result, a possible overcoming of the stop by exerting force on the small protective tube is made more difficult. Secondly, the overhang prevents the small protective tube from being able to be pulled off from the application reservoir in the direction of the nib. The overhang is configured such that it is either rotationally symmetrical with respect to the axis of the small protective tube or is formed by one or more tabs bent out of the circumferential surface of the small protective tube.

In accordance with again an additional feature of the invention, to ensure a secure grip of the marking pen in the protective cap, provision is, preferably, made for at least one third, preferably, approximately 50% to 60%, of the axial length of the gripping region of the pen housing to be accommodated, in the inserted state, within the protective cap.

In accordance with still another feature of the invention, the end of the marking pin that faces away from the nib bears a sealing sleeve of elastic material, in particular, rubber or plastic, which is pushed onto the gripping region and the edge of the sealing sleeve that faces the nib is configured to form a sealing lip. The sealing sleeve, and, in particular, its sealing lip, are constructed such that the sealing lip, when the marking pen is inserted into the protective cap, closes the opening of the protective cap in a dustproof and, preferably, also sprayproof manner so that a penetration of dust or spray into the protective cap is avoided at least when the marking pen is inserted. The sealing sleeve advantageously results in a further simplification of the handling by the end of the sealing sleeve that faces away from the nib being widened to form a wide and, therefore, particularly ergonomic supporting bulge.

In accordance with still a further feature of the invention, the marking pen has a longitudinal end facing away from the nib, a sealing sleeve of elastic material is pushed onto the longitudinal end and has an edge facing the nib, and the edge of the sealing sleeve facing the nib forms a sealing lip sealing the cap opening when the marking pen is inserted into the cap.

In accordance with still an added feature of the invention, the marking pen has a longitudinal end facing away from the nib and a sealing sleeve of elastic material at the longitudinal end, the sealing sleeve having an edge facing the nib and the edge of the sealing sleeve facing the nib forms a sealing lip sealing the cap opening when the marking pen is inserted fully into the cap.

In accordance with a concomitant feature of the invention, the sealing sleeve has an end facing away from the nib and the end of the sealing sleeve facing away from the nib is widened to form a supporting bulge.

Other features that are considered as characteristic for the invention are set forth in the appended claims.

Although the invention is illustrated and described herein as embodied in a marking implement, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

FIG. 1A is a side elevational view of a marking pen of a marking implement according to the invention;

FIG. 1B is a longitudinal cross-sectional and partially perspective view of a protective cap for the marking pen of the marking implement of FIG. 1A along section line IB—IB in FIG. 2;

FIG. 2 is a cross-sectional view of the protective cap of FIG. 1B along section line II—II in FIG. 1B;

FIG. 3 is a fragmentary, enlarged, cross-sectional view of a blocking element of the fastening clip of FIG. 1B;

DESCRIPTION OF THE PREFERRED EMBODIMENTS

Figure 4:
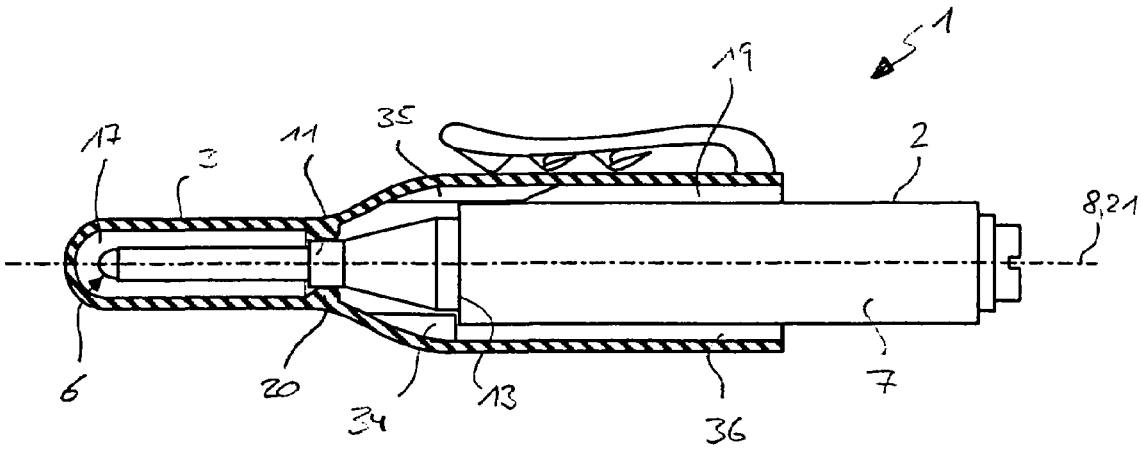
FIG. 4 is a partially cross-sectional and partially side elevational view of the protective cap of FIG. 1B with the marking pin of FIG. 1A inserted therein.

Mutually corresponding parts and sizes are always provided with the same reference numbers in all of the drawings.

Referring now to the figures of the drawings in detail and first, particularly to FIG. 1 thereof, there is shown a marking implement 1 including a marking pen 2 (illustrated in FIG. 1A) and a protective cap 3 (illustrated in FIG. 1B) into which the marking pen 2 can be inserted. The marking pen 2 is configured as a permanent marker and includes a pen housing 4 that is, preferably, of plastic. The marking pen 2 furthermore includes an application reservoir 5 of a fiber material, which is accommodated in a fixed position in the pen housing 4 and protrudes out of the pen housing 4 at a nib 6 of the marking pen 2.

The marking pen 2 is divided into a comparatively wide and substantially cylindrical gripping region 7 that faces away from the nib 6 and is formed by the pen housing 4. This gripping region 7 is adjoined axially with respect to a pen axis 8 by a comparatively thin neck region 9 that bears the nib 6 on the free end side. The neck region 9 is formed by a conical housing section 10 and an approximately cylindrical bearing section 11 of the pen housing 4, which section 11 adjoins the housing section 10 in the direction of the nib 6.

In the direction of the nib 6, the pen housing 4 is extended by a thin small protective tube 12, preferably, of metal, which surrounds the application reservoir 5. The axial length of the neck region 9, including the housing section 10, the bearing section 11, and the small protective tube 12, is, preferably, at least 25%, in particular, approximately one-third of the axial length of the marking pen 2. A step-shaped shoulder 13 is formed on the pen housing 4, between the neck region 9 and the gripping region 7.

The protective cap 3, which, likewise, preferably is of plastic, encloses an elongate interior 14 that opens out in an opening 16 at one longitudinal end 15. The interior 14 has a shaping matched to the shape of the marking pen 2 and, to this extent, includes a narrow interior section 17 for accommodating the neck region 9 of the marking pen 2, which region extends in a transition region 18 in the direction of the opening 16 to form a wide interior section 19. The latter is provided for partially accommodating the gripping region 7 of the marking pen 2. Between the narrow interior section 17 and the transition region 18, an annular sealing bead 20 narrows the interior 14. The interior 14 is formed substantially rotationally symmetrically with respect to a cap axis 21. The protective cap 3 has an outer surface 22, which substantially corresponds to the shape of the interior 14 and continuously expands, in particular, in a section corresponding to the transition region 18.

The protective cap 3 furthermore includes an elastically deflectable fastening clip 23 that is curved approximately in an S shape. The fastening clip 23 is integrally formed on the outer surface 22 with a fixed end 24 in a region of the protective cap 3 that is adjacent to the opening 16, and runs from there along the protective cap 3 approximately parallel to the cap axis 21 at a certain distance from the outer surface 22 so that that free end 25 of the fastening clip 23 that faces away from the fixed end 24 faces away from the open longitudinal end 15 of the protective cap 3 and faces the opposite, closed longitudinal end 26 of the protective cap 3.

On an inner surface 27 of the fastening clip 23, which surface faces the outer surface 22 of the protective cap 3, the fastening clip 23 bears two blocking elements 28 that are offset axially with respect to each other. In the region of the free end 25, the inner surface 27 is, furthermore, provided with a retaining projection 29 whose tip bears substantially against the outer surface 22.

The fastening clip 23 serves to fasten the protective cap 3 to a flat object, in particular, to a pocket of work clothes or the like. In such a case, the blocking elements 28, which are described in greater detail below, provide, in particular, if the protective cap is fastened to a soft, flexible material, such as, for example, cloth, a particularly good retention, in the manner of barbs, which counteracts the protective cap 3 being pulled out of the pocket or the like. The retaining projection 29 is effective, in particular, if the protective cap 3 is fastened to a comparatively flat object, for example, a piece of paper or cardboard.

As is apparent, in particular, from FIGS. 2 and 3, each blocking element 28 is in the form of a two-limbed spring clip. Each blocking element 28 is fixed to the inner surface 27 of the fastening clip 23 by a retaining limb 30, the retaining limb 30 extending from the inner surface 27 obliquely in the direction of the opening 16, and, therefore, also in the direction of the fixed end 24, and tapering increasingly with increasing distance from the inner surface 27. A knee 31, at which the retaining limb 30 merges into a free limb 32, is formed at that end of the retaining limb 30 that faces away from the inner surface 27. The free limb 32 is angled away from the retaining limb 30, preferably, by an angle of between 60° and 100° so that its free end 33 is, in turn, orientated obliquely in the direction of the inner surface 27. As emerges, in particular, from FIG. 2, the free limb 32 is configured to perform a comparatively wide supporting surface 34 that provides particularly good resistance to the cloth of a pocket or some other soft object, to which the protective cap 3 is fastened, without, in the process, damaging or even tearing the cloth or object.

As can be seen, in particular, in an overall view of FIGS. 1B and 2, three projection-like stops 39 are provided in the interior 14 of the protective cap 3 and interact with the shoulder 13 of the marking pen 2 to limit the introducing distance of the marking pen 2 into the protective cap 3 in a defined manner. In such a case, the stops 39 are offset in each case by an angle of 120° with respect to one another about the circumference of the protective cap 3. Furthermore, three centering projections 35 are disposed offset in alternating fashion in respect to the stops 39 in the interior 14. These centering projections 35 serve to center the marking pen 2 with respect to the protective cap 3 in the state in which it is inserted into the protective cap 3, so that the pen axis 8 coincides with the cap axis 21.

This insertion position of the marking pen 2 in the protective cap 3 is illustrated in FIG. 4, in which it can be seen, in particular, that the centering projections 35 engage in the gripping region 7 of the marking pen 2 on the outer circumference thereof. In such a case, the centering projections 35 are dimensioned such that they act radially with a predetermined retaining force on the gripping region 7 so that the marking pen 2 is retained captively in the protective cap 3. It is, furthermore, clear from the illustration according to FIG. 4 that the outside diameter of the marking pen 2 in the gripping region 7 thereof is selected in relation to the inside diameter of the protective casing 3 in the corresponding, wide interior section 19 such that, in the inserted state, an annular gap 36 is formed between the gripping region 7 of the marking pen 2 and the protective casing 3, the radial thickness of which gap is approximately 0.35 mm. The centering projections 35 in this case ensure that the thickness of the annular gap 36 is substantially constant around the circumference of the marking pen 2, and that, in particular, the marking pen 2 does not, therefore, bear against the interior wall of the protective cap 3. The annular gap 36 prevents the marking pen 2 from jamming in the protective cap 3 because of small particles of dust or the like that adhere to the gripping region 7. In addition, the substantially contactless mounting of the marking pen 2 in the protective cap 3 avoids dust or other contaminants being rubbed off from the gripping region 7 of the marking pen 2 onto the interior wall of the protective cap 3, which would gradually soil the protective cap 3 under dirty environmental conditions.

The insertion position of the pen 2 with respect to the protective cap 3, which position is illustrated in FIG. 4, is defined, in particular, by the shoulder 13 of the pen housing 4 striking against the corresponding stops 39 of the protective cap 3. At the same time, in the inserted position, the sealing bead 20 bears circumferentially against the bearing section 11 of the pen housing 4. As a result, the narrow interior section 17 with the nib 6 of the marking pen 2 enclosed in it is sealed off in an airtight manner with respect to the environment. The marking pen 2 is, thereby, protected against drying out.

Figure 5:
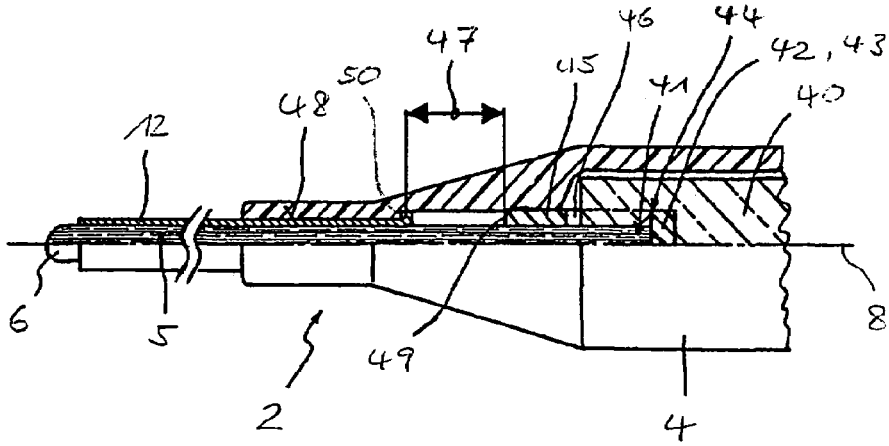
FIG. 5 is a fragmentary, partially cut-away side elevational view of the marking pin of FIG. 1.

FIG. 5 shows, on an enlarged scale, a front section of the marking pen 2 in a longitudinal section, embodied in half a side, along the pen axis 8. In FIG. 5, it can be seen, in particular, that the pen housing 4 contains a store or reservoir 40 for a liquid application medium. In such a case, the application medium used is, in particular, liquid ink based on alcohol as the solvent. An application medium of this type has the advantage, in particular, that it can be applied on virtually any desired surfaces, in particular, plastic, metal, stone, wood, or glass. It is, therefore, particularly suitable for marking operations in the trade sphere.

The application reservoir 5, which is illustrated in detail in FIG. 5, has a constant diameter over its entire length. The application reservoir 5 bears with a rear end section 41 against a stop 42 that is formed by the base 43 of a sleeve 44. On its encircling collar 45 that protrudes away from the base 43, the sleeve 44 is provided with a number of holes 46 through which the store 40 is connected fluidically to the application reservoir 5. The sleeve 44 is fixed in the pen housing 4 by the collar 45.

Figure 6:
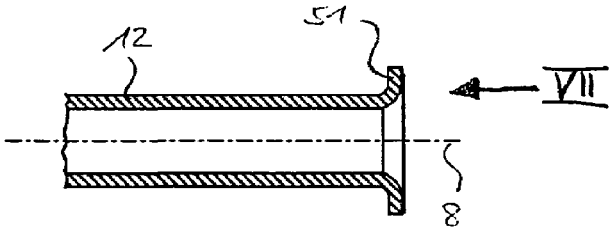
FIG. 6 is a fragmentary, enlarged, cross-sectional view of a protective tube of the marking pen of FIG. 1A.
Figure 7:
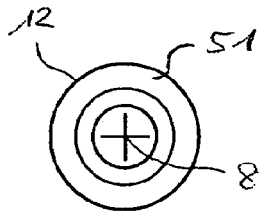
FIG. 7 is a plan view of the protective tube of FIG. 6 from the direction VII in FIG. 6.
Figure 8:
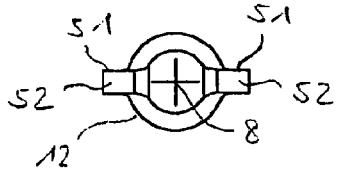
FIG. 8 is a plan view of an alternative embodiment of the protective tube of FIG. 6 from the direction VII in FIG. 6.

To ensure a writing performance that remains the same regardless of the degree to which the application reservoir 5 is used up, the small protective tube 12 is guided such that it can be displaced back axially from the position illustrated in FIG. 5 by a push-back distance 47 in relation to the pen housing 4 and the application reservoir 5, which is in a fixed position with the pen housing 4. In such a case, the inside diameter of the small protective tube 12 and the outside diameter of the application reservoir 5 are coordinated with each other such that the small protective tube 12 surrounds the application reservoir 5 with a predetermined frictional fit tolerance. The fit enables the small protective tube 12 to be displaced back on the application reservoir 5 with a force that is predetermined by the frictional fit tolerance. This force is dimensioned such that, in the course of the use of the marking pen 2, the small protective tube 12 is gradually set back automatically as the application reservoir 5 is increasingly used up. To guide the small protective tube 12, a hole is formed on the pen housing 4 as a guide section 48 for this purpose. The push-back distance 47 of the small protective tube 12 is limited toward the side facing away from the nib 6 by a stop 49 that is fixed on the housing and is formed by the edge of the collar 45. A second stop 50, which limits the push-back distance 47 toward the side facing the nib 6, prevents the small protective tube 12 from being able to be pulled off over the nib 6. In such a case, the stop 50 interacts with an overhang 51 of the small protective tube 12, which overhang is disposed on the housing side and is illustrated on an enlarged scale in FIGS. 6 and 7. The overhang 51 is, preferably, configured, according to FIGS. 6 and 7, as an annular expansion of that edge of the small protective tube 12 that is on the housing side. As an alternative, the overhang 51 may, in accordance with FIG. 8, also be formed by one or more tabs 52 that are formed on that edge of the small protective tube 12 that is on the housing side and that are bent away approximately radially outward from the pen axis 8.

Figure 9:
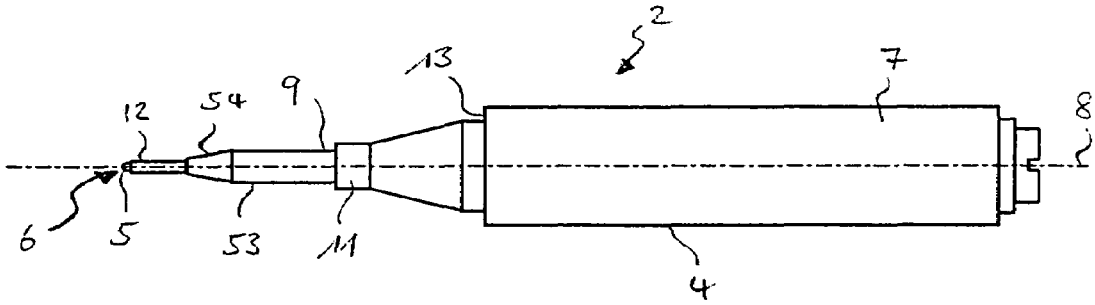
FIG. 9 is a side elevational view of an alternative embodiment of the marking pen of FIG. 1A.

FIG. 9 illustrates an alternative embodiment of the marking pen 2, which is provided especially for a particularly fine nib 6. In this embodiment, the marking pen 2 includes a pen housing 4 that is configured identically to the pen housing 4 of the previously described variant in FIG. 1A. However, instead of the small protective tube 12, an extension tube 53 is inserted into the pen housing 4. The outside diameter of the extension tube 53 is dimensioned, in particular, such that the extension tube 53 is connected to the pen housing 4 in a fixed position with a press fit. At an end facing the nib 6, the extension tube 53 bears a conical guide element 54 for a small protective tube 12, the guide element 54 having a comparatively small outside diameter that is matched to the diameter of the application reservoir 5.

Figure 10:
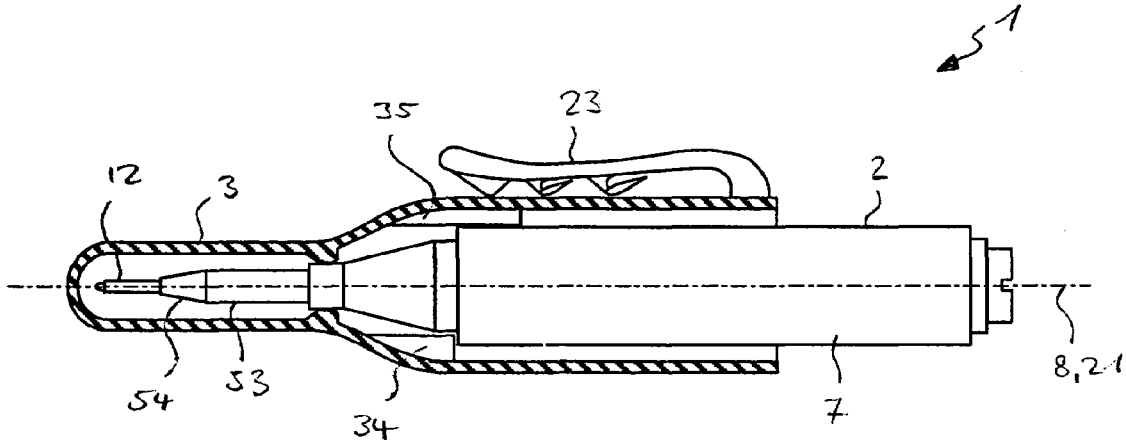
FIG. 10 is a partially longitudinal cross-sectional and partially side elevational view of the pen of FIG. 9 in the protective cap of FIG. 1B.

In the same manner as the variant of the marking pen according to FIG. 1A, the second embodiment of the marking pen 2 that is illustrated in FIG. 9 can be inserted, as illustrated in FIG. 10, into the protective cap 3.

Figure 11:
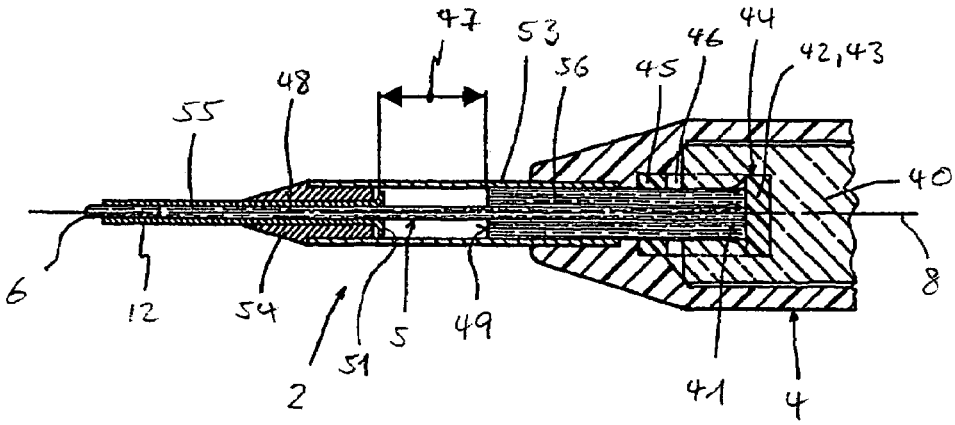
FIG. 11 is a fragmentary, longitudinal cross-sectional view of the marking pen of FIG. 9.

FIG. 11 illustrates a front section of the embodiment of the marking pen 2 according to FIG. 9 in a longitudinal section. The illustration of FIG. 11 shows that the application reservoir 5 is divided here into a first reservoir section 55 and a second reservoir section 56. The first reservoir section 55 is disposed in a region adjacent to the nib 6 and has a comparatively small diameter substantially corresponding to the inside diameter of the small protective tube 12. The second reservoir section 56 is disposed within the extension tube 53 and, therefore, on the housing side with respect to the first reservoir section 55, and completely fills the extension tube 53. Thereby, the second reservoir section 56 is, in particular, widened in relation to the first reservoir section 55.

Also in the case of the embodiment of the marking pen 2 according to FIG. 9, the small protective tube 12 can be displaced back axially in relation to the pen housing 4 including the extension tube 53 and in relation to the application reservoir 5, which is in a fixed position with the pen housing 4. In such a case, a central hole of the guide element 54 acts as the guide section 48. The stop 49 on the housing side that limits the push-back distance 47 of the small protective tube 12, is formed, according to FIG. 11, by the edge of the wide reservoir section 56. In such a case, the overhang 51 of the small protective tube 12 acts as a supporting surface that prevents the small protective tube 12 from being pressed beyond the stop 49 into the wide second reservoir section 56.

Figure 12:
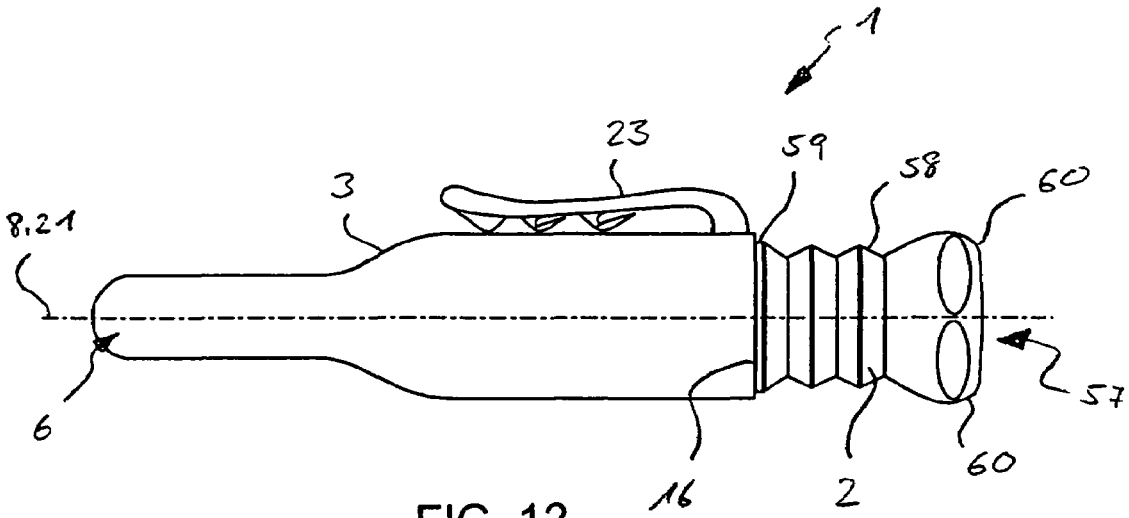
FIG. 12 is a side elevational view of another embodiment of the marking implement according to the invention with a protective cap and a marking pen inserted therein and with a sealing sleeve in a sealing postion where the opening of the protective cap is sealed to the marking pen.
Figure 13:
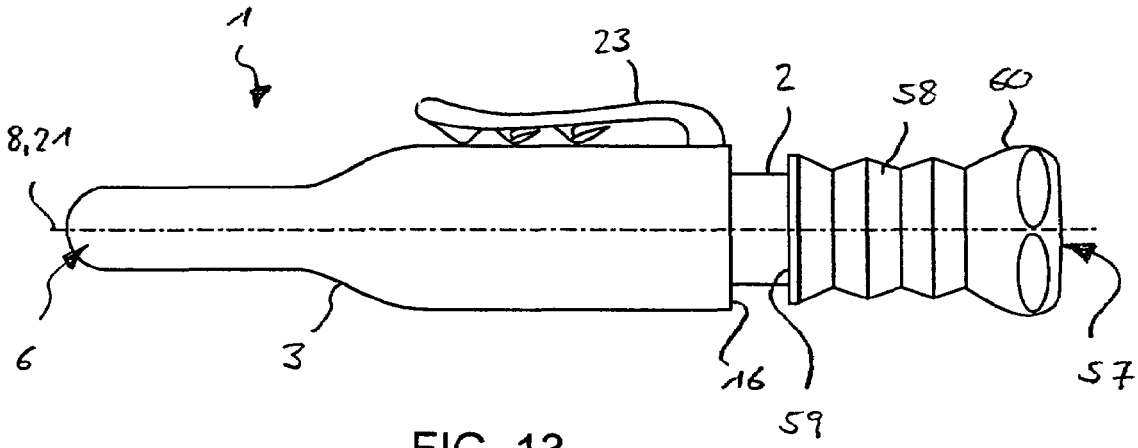
FIG. 13 is a side elevational view of the marking implement of FIG. 12 with the sealing sleeve in a non-sealing postion where the marking pen is slightly out of the cap and the opening of the protective cap is not sealed to the marking pen.

FIGS. 12 and 13 show a variant of the marking implement 1, in which a sealing sleeve 58 is pushed, in particular, pressed, onto the longitudinal end 57 of the marking pen 2 that faces away from the nib 6. In such a case, the sealing sleeve 58 is of a flexible plastic or rubber.

A sealing lip 59 is formed on an edge of the sealing sleeve 58 that faces the nib 6. The sealing sleeve 58 and, in particular, the sealing lip 59 thereof, are dimensioned such that, in the inserted position of the marking pen 2 in the protective cap 3 illustrated in FIG. 12, the sealing lip 59 rests under pre-stress on the edge of the opening 16 so that, when the marking pen 2 is inserted into the protective cap 3 (as shown in FIG. 12), the opening 16 is sealed off against the penetration of dust and spray. The end of the sealing sleeve 58 that faces the longitudinal end 57 of the marking pen 2 is, preferably, widened to form a supporting bulge 60 or supporting head, which improves the ergonomics and, therefore, the handling ability of the marking pen 2.

I claim:

1. A marking implement, comprising:

a marking pen having:

a pen housing having:

a relatively wide gripping region; and a relatively thin neck region adjoining said gripping region, said neck region having a free end side and a nib on said free end side; and an application reservoir axially fixedly held in said pen housing;

a protective cap defining an elongate interior opening out at a cap opening for at least partially accommodating said marking pen therein;

said cap having:
an outer surface; and
an end facing away from said cap opening;
said interior of said cap having:
a relatively wide interior section for at least partially accommodating said gripping region of said marking pen; and
a relatively narrow interior section for accommodating said neck region of said marking pen; and
a fastening clip:
being disposed on said outer surface of said cap;
being integrally formed on said cap;
having a fixed end connected to said cap in a region adjacent said cap opening;
a free end closer to said end of said cap facing away from said opening than said fixed end; and
tapering from said fixed end towards said free end.

2. The marking implement according to claim 1, wherein said clip has:
an inner surface facing said outer surface of said cap;
at least one barb-shaped blocking element formed on said inner surface and protruding therefrom substantially in a direction of said fixed end of said clip.

3. The marking implement according to claim 1, wherein said clip has:
an inner surface facing said outer surface of said cap;
at least one blocking element formed on said inner surface and protruding therefrom substantially in a direction of said fixed end of said clip in the manner of a barb.

4. The marking implement according to claim 2, wherein said at least one blocking element has:
a retaining limb integrally formed on said inner surface of said clip and protruding therefrom obliquely in a direction of said fixed end of said clip;
a free limb having a free end and being angled with respect to said retaining limb to obliquely orient said free end of said free limb in a direction of said inner surface of said clip.

5. The marking implement according to claim 4, wherein said retaining limb tapers from said inner surface of said clip in a direction of said free limb.

6. The marking implement according to claim 5, wherein said retaining limb tapers outwardly from said inner surface of said fastening clip in a direction of said free limb.

7. The marking implement according to claim 4, wherein said free limb of said at least one blocking element is a supporting plate.

8. The marking implement according to claim 1, wherein:
said interior of said cap has an inner surface; and
said cap has a sealing bead at said inner surface extending toward a center of said interior, said sealing bead sealingly surrounding said marking pen at said neck region of said marking pen when said marking pen is inserted in said cap.

9. The marking implement according to claim 1, wherein
said marking pen has a step-shaped shoulder between said gripping region and said neck region; and
at least one stop is disposed in said interior of said cap and operatively interacts with said shoulder when said marking pen is inserted in said cap.

10. The marking implement according to claim 1, wherein:
said cap has an inner wall;
said relatively wide interior section of said cap has an inside diameter; and
said gripping region has:
an outer circumference;
an outside diameter smaller than said inside diameter of said relatively wide interior section to form an annular gap between said outer circumference of said gripping region and said inner wall of said cap when said marking pen is inserted into said cap.

11. The marking implement according to claim 10, wherein said annular gap has a radial thickness of at least 0.2 mm.

12. The marking implement according to claim 10, wherein said annular gap has a radial thickness in a range between approximately 0.3 mm and approximately 0.5 mm.

13. The marking implement according to claim 10, wherein said annular gap has a radial thickness of approximately 0.35 mm.

14. The marking implement according to claim 10, wherein:
said inner wall of said cap has at least one centering projection; and
when said marking pen is inserted in said cap, said at least one centering projection bears against said outer circumference of said gripping region of said marking pen to coaxially hold said marking pen within said cap.

15. The marking implement according to claim 14, wherein said at least one centering projection captively retains said marking pen when inserted into said cap.

16. The marking implement according to claim 10, wherein:
said inner wall of said cap has a plurality of interacting centering projections; and
when said marking pen is inserted in said cap, said centering projections bear against said outer circumference of said gripping region of said marking pen to coaxially hold said marking pen within said cap.

17. The marking implement according to claim 16, wherein said centering projections captively retain said marking pen when inserted into said cap.

18. The marking implement according to claim 1, further comprising a protective tube:
surrounding said application reservoir in a region of said nib;
being axially displaceably connected to said relatively thin neck region; and
moving axially with respect to said application reservoir over a push-back distance in a direction of said pen housing when a defined force is imparted to said protective tube.

19. The marking implement according to claim 18, wherein said protective tube has at least a portion thereof relatively thinner than said relatively thin neck region.

20. The marking implement according to claim 18, wherein said pen housing has a stop limiting said push-back distance of said protective tube.

21. The marking implement according to claim 18, wherein said guide section axially guides said protective tube.

22. The marking implement according to claim 18, wherein:
said application reservoir has first and second axially adjoining reservoir sections of different diameters, said first reservoir section is disposed in a region of said nib; and
said protective tube has an inside diameter that, taking into account a frictional fit tolerance, is matched to said diameter of said first reservoir section.

23. The marking implement according to claim 22, wherein said second reservoir section is disposed at said housing and forms a stop for said protective tube, said stop limiting said push-back distance of said protective tube.

24. The marking implement according to claim 18, wherein said protective tube has an end at said housing and said end has an overhang.

25. The marking implement according to claim 18, wherein said protective tube has an end facing said housing and said end forms an overhang releasably securing said protective tube to said neck region.

26. The marking implement according to claim 1, wherein at least a third of an axial length of said gripping region of said marking pen is accommodated within said cap when said marking pen is inserted into said cap.

27. The marking implement according to claim 1, wherein:

said marking pen has a longitudinal end facing away from said nib;

a sealing sleeve of elastic material is pushed onto said longitudinal end and has an edge facing said nib; and said edge of said sealing sleeve facing said nib forms a sealing lip sealing said cap opening when said marking pen is inserted into said cap.

28. The marking implement according to claim 1, wherein:

said marking pen has a longitudinal end facing away from said nib and a sealing sleeve of elastic material at said longitudinal end, said sealing sleeve having an edge facing said nib; and said edge of said sealing sleeve facing said nib forms a sealing lip sealing said cap opening when said marking pen is inserted fully into said cap.

29. The marking implement according to claim 27, wherein:

said sealing sleeve has an end facing away from said nib; and said end of said sealing sleeve facing away from said nib is widened to form a supporting bulge.

30. The marking implement according to claim 1, wherein said application reservoir is fluidically connected to said nib.

31. The marking implement according to claim 1, wherein said at least one blocking element is a plurality of blocking elements.

* * * * *